United States Patent [19]

Swartz

[11] 4,253,282

[45] Mar. 3, 1981

[54] PREFORMED MANHOLE BASE SECTION CONSTRUCTION

[76] Inventor: Benjamin E. Swartz, P.O. Box 466, Grass Valley, Calif. 94945

[21] Appl. No.: 877,836

[22] Filed: Feb. 15, 1978

[51] Int. Cl.[3] ..... E02D 29/12

[52] U.S. Cl. ..... 52/20; 52/21

[58] Field of Search ..... 52/19–21; 285/189, 192

[56] References Cited

U.S. PATENT DOCUMENTS

| | | | |
|---|---|---|---|
| 3,744,806 | 7/1973 | Keyser | 52/21 X |
| 3,787,078 | 1/1974 | Williams | 52/21 X |

FOREIGN PATENT DOCUMENTS

| | | | |
|---|---|---|---|
| 2253857 | 5/1973 | Fed. Rep. of Germany | 52/20 |
| 1363302 | 8/1974 | United Kingdom | 52/20 |
| 1507106 | 4/1978 | United Kingdom | 52/20 |

OTHER PUBLICATIONS

Engineering News. Record, Nov. 1, 1962, p. 12.

*Primary Examiner*—J. Karl Bell

*Attorney, Agent, or Firm*—David B. Harrison

[57] ABSTRACT

A preformed concrete unitary manhole base section is formed with a polygonal exterior wall with a plurality of substantially flat faces each aligned in a different direction. Some of the faces are formed with cylindrical openings into which standard drain conduit end portions closely fit. Compressible annular seals between the opening walls and the end portions effect a watertight seal between the section and the conduits. Interior flow contours are formed within the section between the openings. Separate plural handling and alignment facilitating means are formed in the exterior wall.

5 Claims, 10 Drawing Figures

FIG. 4
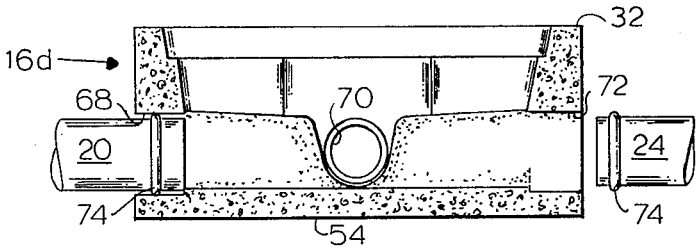
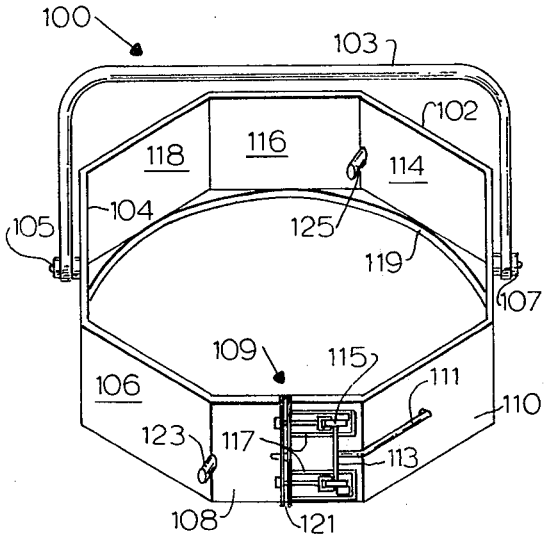
FIG. 5
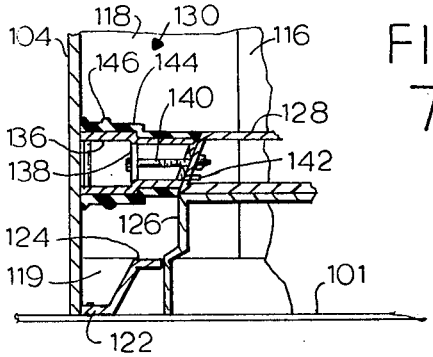
FIG. 7
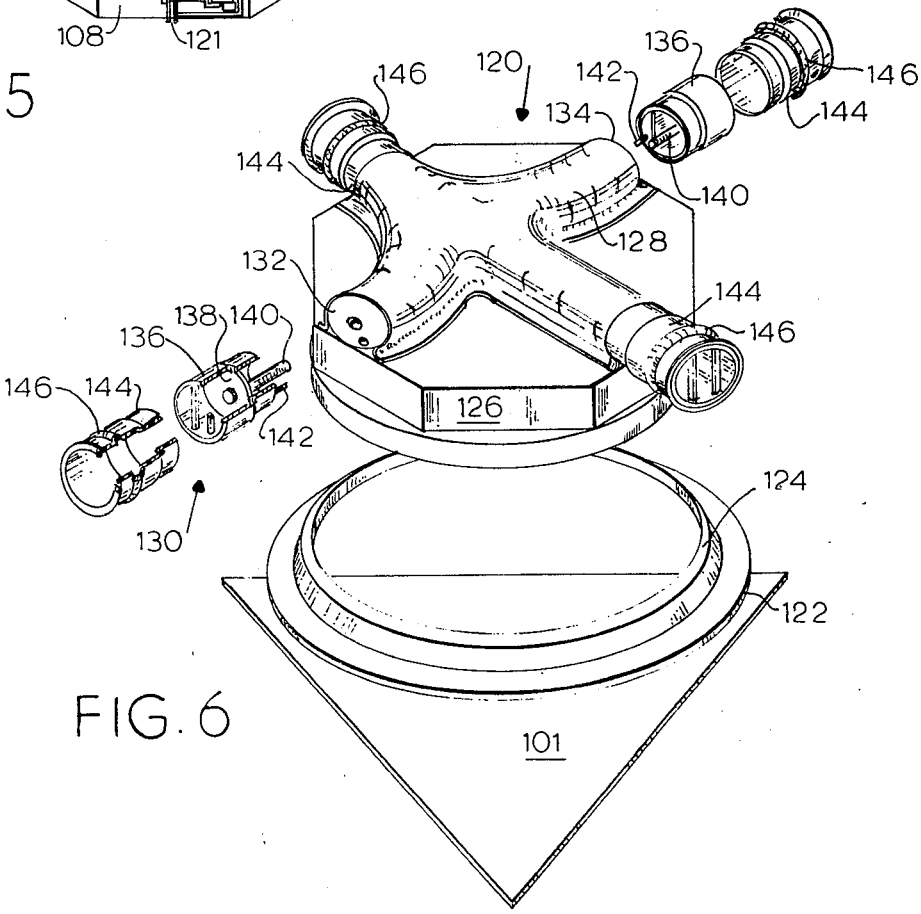
FIG. 6

PREFORMED MANHOLE BASE SECTION CONSTRUCTION

BACKGROUND OF THE INVENTION

The present invention relates to construction for preformed base sections for manhole drops in sewer lines. More particularly the present invention relates to a prefabricated manhole base section.

Vertical manholes enabling human worker access to sewer, water, drainage and other varied conduits have been known and used for many years. Typically, such manholes are covered with a metal cap at street or surface level, and extend downwardly to the grade of the conduit. Such manholes are usually installed at the location of confluence of several sewer lines into one outflow conduit. These bases provide structure defining flow transitions from one or multiple directions to the direction of a common outflow. Such manhole constructions of the prior art were typically formed in place through the casting of hardenable concrete material and are illustrated in Urquhart's *Civil Engineering Handbook,* Fourth Edition, McGraw-Hill, particularly at pages 9–20, FIG. 18.

In more recent years it was proposed to precast manhole base sections of concrete. Those sections were cured and then set in place in a manhole excavation and connected to the flow conduit. Large diameter concrete pipe sections were then installed vertically on the base section and capped with a cover to form the completed manhole construction. The ornamental features of one such manhole base section were shown in U.S. Pat. No. Des. 215,357.

One problem of such prior art preformed manhole base sections arose from the fact that they were cast around stubs of pipe at the locations of joinder of the conduit with the base sections. The stubs were necessary to enable coupling of the conduits to the base section and significantly complicated the fabrication process of such sections. Moreover, with the recent and widespread adoption of plastic drain conduit and piping, it has been found that plastic stubs cast into manhole base sections tended to separate from the surrounding cured concrete material and leak.

Heretofore there has been no effective fabrication techniques for producing prefabricated manhole base sections which are unitary castings without stubs and which provide for joinder of incoming and outgong conduits in openings which accommodate sealing gaskets to provide watertight seals between the conduit and the base section.

The base sections constructed in accordance with the prior art had a further disadvantage of requiring separate molds for each separate configuration of inlets, outlets, and flow patterns.

These and other disadvantages and limitations of the prior art are overcome by the present invention.

SUMMARY OF THE INVENTION

One object of the present invention is to provide an improved prefabricated manhole base made of molded concrete.

Another object of the present invention is to provide a preformed manhole base section to which a wide variety of different conduits may be directly coupled in positive sealing engagement.

A further object of the present invention is to provide an improved fabrication technique for preformed manhole base sections.

These and other objects and advantages are accomplished in accordance with the principles of the present invention which will now be described.

A prefabricated concrete unitary manhole base section constructed in accordance with the present invention is installable beneath and supports a vertically aligned cylindrical conduit of sufficient inside diameter to form a manhole for entry of a human worker for inspection or repair. The manhole base section includes a substantially flat bottom exterior surface, plural flat sidewalls formed at the periphery of the section, each sidewall facing a different direction from the others. At least one sidewall defines an inlet opening therein for receiving one end of an inlet conduit in a close fitting sealing engagement therewithin. Another of the sidewalls which is aligned at least perpendicular to the sidewalls having inlet openings provides an outflow opening for receiving one end of an outflow conduit in a close fitting sealing engagement therewithin. Interior flow contours are provided within the section to define a flow-way between the inlet openings and the outflow opening. The section is fitted with an annular top lip along the top of the sidewalls for mating with the vertically aligned cylindrical conduit. Each opening within each sidewall cooperates with a sealing gasket for sealing the conduit inserted thereinto.

Separate receptacles are oppositely placed in the sidewall structure to facilitate handling and final in situ alignment.

Other objects, advantages and features of the present invention will become apparent from the following detailed description of embodiments presented in conjunction with the accompanying drawings.

BRIEF DESCRIPTION OF THE DRAWINGS

In the drawings:

FIG. 4 is a sectional view in side elevation of an alternative form of a manhole base section incorporating the principles of the present invention.

FIG. 5 is a perspective view of an outer shell of a mold for forming the manhole base section shown in FIGS. 1–3.

FIG. 6 is an exploded view in perspective of molding elements which combine to form a mold enabling fabrication of a manhole base section of the type shown in FIG. 2. Some of the molding elements are shown in sectional view.

FIG. 7 is an enlarged detail view in side elevation and section of some of the elements of the mold shown in FIG. 6 which form an opening in the base section for a connecting conduit.

DETAILED DESCRIPTION OF PREFERRED EMBODIMENTS

Figure 1:
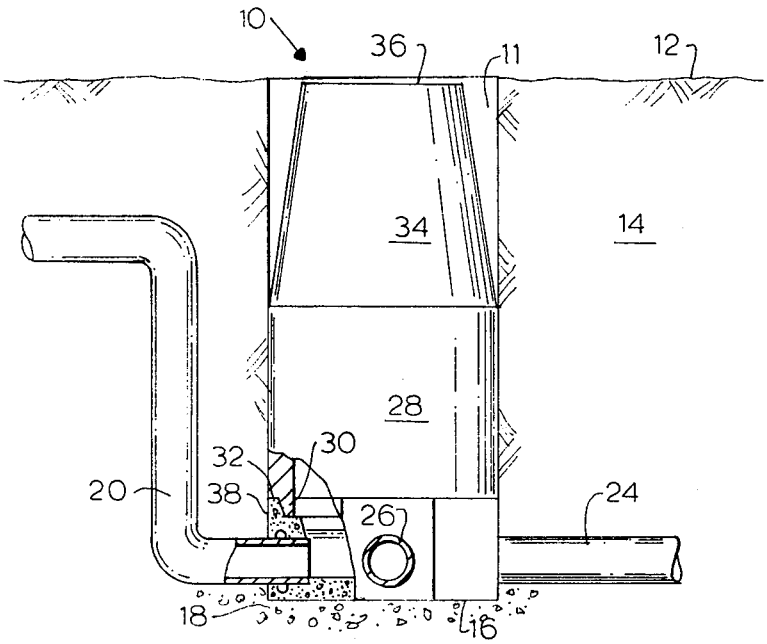
FIG. 1 is a somewhat diagrammatic view in side elevation of a manhole structure incorporating a prefabricated manhole base section formed in accordance with the principles of the present invention. A portion thereof is broken away.
Figure 2:
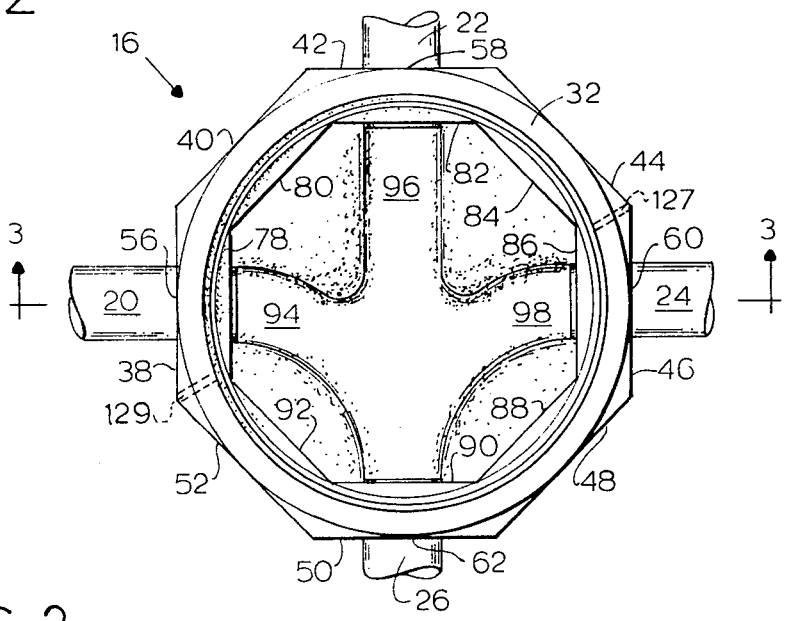
FIG. 2 is a top plan view of the manhole base section shown in FIG. 1 with the connecting conduit broken off to conserve drawing room.
Figure 3:
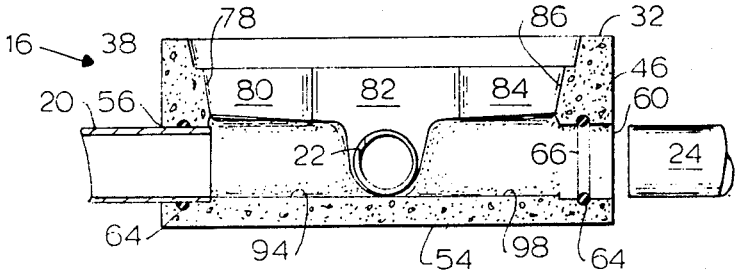
FIG. 3 is a sectional view in side elevation of the manhole base section taken along the line 3—3 in FIG. 2.

Referring to FIG. 1, a manhole structure 10 is shown installed in a cylindrical excavation 11 extending vertically below a surface grade 12 of the earth 14. The structure 10 is formed with a base section 16 prefabricated in accordance with the principles of the present invention. The base section rests upon a suitable ballast of crushed and compacted rock 18 or other suitable backfill material placed in the manhole excavation to establish the proper grade for the base 16. As shown in FIGS. 1–3, inlet conduits 20, 22 and 24 are inserted into the manhole base section at separate vertical faces thereof from differing directions. As outflow conduit 26 extends from the manhole base section at an opening provided at yet another external vertical face of the multifaced base section 16.

A standard large diameter precast concrete pipe section 28 is placed upon the base section 16. A projection 30 on the pipe section 28 engages a complementary projecting top annular lip 32 of the base section 16 to hold the pipe section 28 in axial alignment. In a similar locking engagement a truncated conical precast concrete pipe section 34 rests upon the standard pipe section 28. The open smaller end of the conical section 34 is capped with a conventional cast iron manhole cover 36 to complete the construction of the manhole structure 10.

Focusing now upon the structural details of the prefabricated manhole base section 16, and referring to FIGS. 2 and 3, the section 16 is cast in an octagonal shape having eight external vertical sides 38, 40, 42, 44, 46, 48, 50 and 52 each aligned in a different vertical plane. The base 16 has a continuous bottom portion 54, and as noted previously the projecting annular lip 32 extends continuously about the outer periphery at the top of the base section 16.

Figure 8:
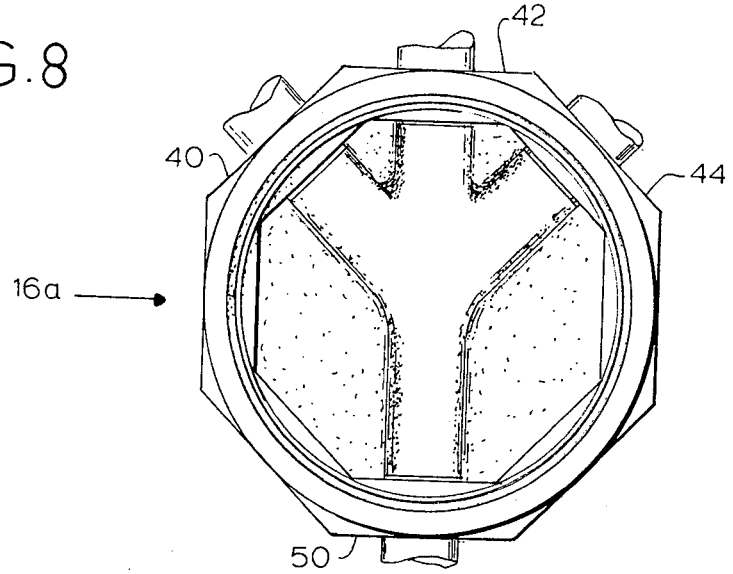
FIG. 8 is a diagrammatic plan view of a manhole base section pursuant to the present invention having an alternate flow configuration.
Figure 9:
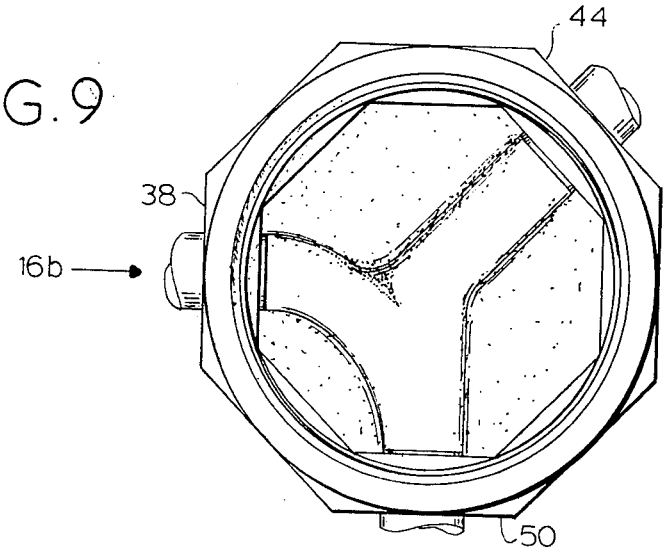
FIG. 9 is a diagrammatic plan view of another flow configuration in a manhole base section of the present invention.
Figure 10:
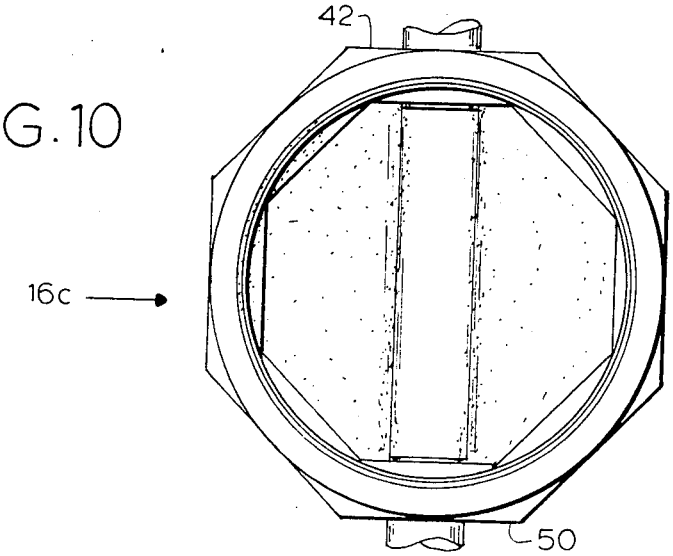
FIG. 10 is a diagrammatic plan view of a different flow configuration in a manhole base section of the present invention.

As shown in FIG. 2, openings 56, 58, 60 and 62 are provided respectively in the faces 38, 42, 46 and 50 of the base 16. The openings are preformed into cylindrical passages to receive therein the conduits 20, 22, 24 and 26 in closely fitting, sealing engagements. The selection of the faces 38, 42, 46 and 50 of the example base 16 of FIG. 2 is made to conform with the requirements of the drainage system of which the manhole structure 10 forms a part. In accordance with the present invention the base 16 may be configured to receive inlet conduits from many different combinations of directions. For example, the base **16*a* shown in FIG. 8 provides inlet openings at its faces 40, 42 and 44; the base 16*b* shown in FIG. 9 provides inlet openings at its faces 38 and 44; and, the base 16*c* shown in FIG. 10 provides a single inlet opening at its face 42. The bases 16*a*, 16*b* and 16*c* are each provided with an outflow conduit opening at the face 50. The bases 16, 16*a*, 16*b* and 16*c* of FIGS. 2, 8, 9 and 10, respectively, are intended to be illustrative of some of the many different combinations of directions of flow which may be accommodated by manhole bases constructed in accordance with the principles of the present invention. Although the base 16 is shown to be octagonal, other geometric forms are suitable so long as the faces thereof are generally flat and normal to the longitudinal axis of the conduit at the region at which it enters the movable base section. The geometrical outer shape has proven to provide a superior base construction 16 which readily interfaces with the large diameter vertical pipe 28** which provides an unlimited variety of drain pipe connection combinations, and which minimizes construction material.

An important feature of the present invention is the provision of a seal 64 within the cylindrical openings 56, 58, 60 and 62. The seal is preferably an O-ring of suitable elastomeric material. In the embodiment of FIGS. 1–3, the openings 56, 58, 60 and 62 of the base 16 are each provided with a curved channel 66 for seating the gasket 64 (perhaps best shown in FIG. 3 at the opening 60). The gasket 64 is compressed when the conduit 24 is placed on position in the opening 60 and thereby achieves a watertight seal as shown by the conduit 20 seated in place in its opening 56. I prefer to use the rubber sealing gasket made by or for the company that manufactures the particular pipe to be connected to the manhole base section 16. Such gaskets are normally used in joining sections of pipe together. Of course, the size and shape of the rubber gasket will be governed by the size and shape of the conduit which will be used with the base 16.

An alternative conduit sealing arrangement is illustrated in FIG. 4. In the prefabricated manhole base section **16*d* illustrated in FIG. 4, openings 68, 70 and 72 are smooth and without any groove for the O-ring. In this base 16*d*, I prefer to use a special gasket 74 known as a gear grip rubber gasket ring, made by Hamilton Kent Mfg. Co. of Kent, Ohio and Sparks, Nev. The gasket 74 is placed on the outside of the conduit 24. The conduit 24 is then rotated into the opening 72 which compresses the gasket 74 to provide the desired watertight seal. A compressed gasket 74 is shown in FIG. 4 between the opening 68 and its conduit 20**.

Referring again to FIG. 2, the interior of the base 16 is provided with hexagonal surfaces 78, 80, 82, 84, 86, 88, 90 and 92 which correspond with outer surfaces 38, 40, 42, 44, 46, 48, 50 and 52, respectively, so as to conserve construction material without impairment of structural integrity of the base section 16. As shown in connection with faces 78 and 86 in FIG. 3, the interior surfaces 78–92 are slightly inwardly sloped to facilitate removal of the mold used to make the base 16 (described hereinafter). The interior also includes structure defining flow channels 94, 96 and 98 which enable confluence of liquids from the conduits 20, 22 and 24 into the outlet conduit 26.

PREFABRICATION OF BASE SECTIONS 16

The preferred fabrication method for bases 16 will best be understood by reference to FIGS. 5, 6 and 7. From these figures it will be appreciated that the base is cast upside down in a two-part mold 100 which is then inverted after initial set and cure and then removed.

The mold 100 includes an outside octagonal shell 102 and an interior die 120. The shell 102 has eight vertical walls 104, 106, 108, 110, 112, 114, 116 and 118 which respectively form the faces 38, 40, 42, 44, 46, 48, 50 and 52 of the precast base 16. So long as an exterior octagonal shape is desired, the shell 102 will be used, regardless of the internal flow configuration or number of conduit openings. Other shells would naturally be provided for other outside geometries. The shell 102 includes an annular ring 119 at the bottom thereof. The ring 119 is tangent with interior surfaces 104, 106, 108, 110, 112, 114, 116 and 118 at each center thereof, and the ring 119 functions to shape outer vertical sidewall surface portion of the annular top lip 32 of the base 16.

The outer shell 102 is provided with a semicircular handle 103 on the outside thereof at two opposite hinges 105 and 107. The hinges 105 and 107 enable the handle to rotate circularly about the outer shell 102 and enable the mold 100 to be lifted, e.g., by a forklift or winch, and inverted to facilitate removal of the outer shell 102 and the inner die 120.

A cammed radial releasing mechanism 109 having a handle 111 is provided to facilitate removal of the outer shell 102. The handle 111 is welded to a shaft 113 to which eccentric cams 115 are attached at each end. The cams bear againt pins 117 and thereby widen a vertical gap 121 in the vertical wall 108 of the shell 102 when the handle 111 is pulled away from the wall 110. This occurs incident to the removal of the outer shell 102 after a base section 16 has been cast and sufficiently cured. The shell 102 is preferably formed of panels of edge-welded steel plate to which the annular ring 119 is also welded. The resiliency of steel facilitates the radial expansion of the shell 102 during operation of the releasing mechanism 109.

Two pins 123 and 125 are removably journalled through opposite edges of the shell 102. These pins 123 and 125 form openings 127 and 129 part way into the base section 16 (shown in FIG. 2). The openings 127 and 129 are for lifting tongs (not shown) which are used in the handling, transportation and final placement of the base 16 at the construction site.

As shown in FIG. 6, the interior die 120 is preferably formed of separate, welded steel portions which fit together to provide the die 120. An annular outer ring portion 122 fits around the lower portion 124 on the base portion which forms the interior vertical sidewall surface portions of the projecting top lip 32 of the base 16. Inside the annular ridge 124 and extending upwardly behind it is an octagonal ridge portion 126 having eight upwardly slanting surfaces which shape the octagonal interior sidewalls 78, 80, 82, 84, 86, 88, 90 and 92 of the base 16. A flow channel portion 128 is formed on top of the octagonal portion 126 and forms the flow passages 94, 96 and 98 within the interior of the completed base 16.

As shown in FIG. 6, the interior die 120 is preferably formed of separate welded steel portions which fit together to provide the interior die 120. A stepped outer ring 122 fits snugly around an inset middle portion 124 which includes eight faces 126 forming the interior octagonal sidewalls of the base 16. A separate flow channel forming portion 128 is bolted onto the middle portion 124 and forms the flow passage contours of the finished precast base 16. The provision of the separate outer ring 122, middle portion 124, and contour portion 128 facilitates removal of the interior die 120 once a cast base 16 has set sufficiently, and it also enables making bases with different interior flow contours by changing only the contour portion 128.

The assembled mold 100 preferably rests upon a triangular slab of steel 101. The triangular shape of the slab 101 enables the entire mold 100 to be balanced on three points, thereby assuring correct positioning of the various parts thereof.

Openings, such as the openings 56, 58, 60 and 62, in the base section 16 are each formed by a detachable cylindrical die assembly 130, FIG. 7, which is assembled and bolted to an outer end 132, 134 of the flow channel portion 128 at the location of each intended opening in the base 16. The cylindrical die assembly 130 includes a stepped metal sleeve 136 which is provided with a transverse wall 138. A bolt 140 has a head which seats in a hole in the brace 134 and engages a threaded opening into the slanted end 132, 134 of the flow die at each location where the conduit will enter the base 16. The inner end of the metal sleeve 136 is slanted to match the slant of the outer ends 132, 134 so that the assembly 130 is mounted in correct alignment. A keying pin 142 is provided at each inner end of the sleeve 136 and mates with a complementary opening into the outer ends 132, 134 of the flow channel portion 128 of the interior die 120. Fitting snugly around the outside of the metal sleeve 136 is an elastomeric collar 144. The collar 144 may be provided with an annular flange 146 which forms the O-ring channel 66 in the openings of the base 16 to accommodate the O-ring seals 64 therein. Alternatively, a collar without any protrusion would be used to shape the openings 68, 70 and 72 of the alternative base embodiment **16*d* illustrated in FIG. 4**.

A base 16 is fabricated by assembling a form 100 by first assembling the interior die 120 and then locking the outer shell 102 around the interior die 120. Prior to casting a base section 16 in the mold 100, all of the interior surfaces and regions thereof are coated with a release agent, such a used automobile engine crankcase oil or any petroleum base liquid of similar viscosity. Freshly mixed concrete slurry, preferably incorporating lightweight aggregate, is then poured into the form 100 and vibrated to remove any entrained air pockets and assure dissemination of the slurry to all interior recesses of the mold 100. After the concrete slurry has hardened and cured to a point where the base 16 so formed will hold its shape, the mold 100 is lifted by the handle 103 and inverted; then the outer shell 102 is removed by operating the release mechanism 109 which brings about radial expansion of the outer shell 102. The pins 123 and 125 are removed before the shell 102 can be lifted off. The interior die 120 is then removed first with the removal of all of the cylindrical die assemblies 130. Each assembly 130 is removed by loosening and withdrawal of the bolt 140, withdrawal of the sleeve 136, and then removal of the elastomeric collar 144. Then, the interior die 120 is removed.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. In a prefabricated concrete unitary manhole base section for providing access to and connection of a plurality of standard subterranean drainpipe conduit at the location thereof, said section having at least one inlet and one outflow, interior structure defining a flow channel from each inlet to the outflow, and annular flange means at periphery of the top of said section for engaging a cylindrical concrete pipe section thereon, the improvement comprising:

a polygonal exterior wall structure having a thickness greater than said annular flange means and a plurality of substantially vertical faces with each face aligned in a different direction than the other faces;

said outflow being a substantially cylindrical lateral opening provided at one of said faces and defined by and extending through said exterior wall structure;

at least one of said inlets being a substantially cylindrical lateral opening provided at another of said faces and defined by and extending through said exterior wall structure, said other face being at least at right angles to said face having said outflow opening therein;

each of said openings being sized and shaped to receive an end portion of a said standard drainpipe conduit directly in a secure closely fitting engagement therewithin;

resilient sealing means compressed between each said opening and said end portion therein for providing a watertight seal therebetween.

2. The improved prefabricated manhole base section of claim 1 comprising a plurality of inlets, each inlet being defined in different faces and wherein said interior structure defines a plurality of merging flow channels to facilitate confluence of liquids flowing from all of said inlets into said outflow.

3. The improved prefabricated manhole base section of claim 1 wherein said sealing means comprises a transverse annular groove in a said opening and an annular elastomeric sealing gasket seated in said groove.

4. The improved prefabricated manhole base section of claim 1 wherein said sealing means comprises an annular elastomeric sealing gasket initially seated around the end portion of a said standard subterranean drainpipe conduit and which beomes compressed against the opening when said end portion is inserted therein, thereby providing a watertight seal between said conduit end portion and the structure of said section defining the opening into which said end portion is fitted.

5. The prefabricated concrete unitary manhole base section set forth in claim 1 further comprising oppositely aligned handling means separately formed in said exterior wall structure for facilitating handling, transportation and in situ alignment of said section.

* * * * *